United States Patent [19]

Sheesley et al.

[11] Patent Number: 4,505,077

[45] Date of Patent: Mar. 19, 1985

[54] CABINET DOOR INTERLOCK

[75] Inventors: Gary Sheesley; Michael Grudzinski, both of Bensalem, Pa.

[73] Assignee: Empire Abrasive Equipment Corporation, Langhorne, Pa.

[21] Appl. No.: 475,820

[22] Filed: Mar. 16, 1983

[51] Int. Cl.[3] ..... B24C 7/00; B24C 3/04

[52] U.S. Cl. ..... 51/415; 51/436; 51/438; 51/426

[58] Field of Search ..... 51/426, 436, 438, 427, 51/410, 415

[56] References Cited

U.S. PATENT DOCUMENTS

| | | | |
|---|---|---|---|
| 2,008,741 | 7/1935 | Allan | 51/426 |
| 2,321,774 | 6/1943 | Ruemelin | 51/426 |
| 3,866,357 | 2/1975 | Callahan et al. | 51/415 |
| 4,300,318 | 11/1981 | Brown | 51/427 |
| 4,360,990 | 11/1982 | Hubbard | 51/426 |

*Primary Examiner*—Frederick R. Schmidt
*Assistant Examiner*—Robert A. Rose
*Attorney, Agent, or Firm*—Sperry, Zoda & Kane

[57] ABSTRACT

A blast cabinet having at least one cabinet door opening into the blast chamber includes a pneumatic interlock between the door and a valve through which air is supplied under pressure to a gun within the chamber. The valve is actuated to an open position by air under pressure admitted under the control of an operator. Incorporated in the tubing system through which the air under pressure is directed to the valve is a header which is left in communication with ambient air whenever the door is open, to depressurize the supply of air to the valve and thus prevent it from opening under these conditions. Whenever the door to the blast chamber is closed, the door seals off from ambient the line through which pressurized air is supplied for operating the main valve through which abrasive-media-laden air is supplied to the blast gun, so that the gun can be operated only when the blast chamber door is fully closed, thus assuring against the danger of abrasive particles being discharged from the blast chamber into nearby work areas.

12 Claims, 5 Drawing Figures

CABINET DOOR INTERLOCK

BACKGROUND OF THE INVENTION

1. Field of the Invention

The present invention relates generally to blast cabinets, that is, enclosures in which workpieces can be blast-finished by a worker who manipulates a blast gun from outside the cabinet. In a more specific sense, the invention relates to a safety device for use on cabinets of this type, in the form of a basically pneumatic interlock system in which the supply of compressed air for operating a blast gun within the cabinet is shut down whenever the access door to the cabinet is not in a tightly closed position.

2. Description of the Prior Art

In blast cabinets of the type generally described above, an abrasive stream is discharged at high velocity from a blast gun against a workpiece supported within a blast chamber of the cabinet. Governmental regulations require, for the safety of individuals working in the vicinity of the blast cabinet, that the access door or doors to the blast chamber be tightly, sealably closed whenever the blast gun is in operation, since the abrasive-laden stream discharged from the gun or nozzle is potentially very hazardous to those working in the vicinity of the cabinet.

To this end, in the prior art various interlock systems between the door and the valve controlling the supply of air under pressure to the blast gun, have been devised. One commonly used method is to provide an electrically actuated main air valve having a solenoid coil connected in series with normally open limit switches provided on each door. Opening of either door opens one of the switches, preventing the supply of electric power to the main air supply valve. Such an arrangement has the disadvantage of requiring the mounting of switches near each cabinet door, with electrical wires mounted on the outside of the cabinet to connect each door switch in circuit with the solenoid valve used to control the main air supply. These components have traditionally been mounted on the cabinet exterior, because the abrasive environment within the cabinet makes it impractical to mount devices of this type within the blast chamber.

Another arrangement used in the prior art is of the pneumatic type, and has been typically used when the total air requirement is small. In these circumstances, normally closed two-way valves are mounted exteriorly of the cabinet adjacent the respective doors, controlling flow from the supply of air under pressure to the main control valve. The closing of the doors opens the two-way valves to allow the pressurized flow to the main valve.

In still other instances, the air flow requirements for the blast gun are too great for mounting the door-controlled valves directly in the main air supply line. Accordingly, in such an event, the main valve is typically actuated by air under pressure provided through a pilot air line. Again, valves mounted adjacent the doors are provided, but in this event are included in the pilot line rather than in the main air supply line. Opening of the doors closes the pilot-air-actuated valves, thus blocking the flow of pilot air under pressure to the main valve as an actuation signal therefor.

Prior art devices of the type described above have disadvantages in that the cost of mounting switches and valves individual to the doors of a blast cabinet should, as will be understood, be eliminated if at all possible. And, even when this cost is incurred for switches or valves of high quality individual to the doors of the blast cabinet, these components have the disadvantage in that they have moving parts, and must be rendered impervious to contamination by dust and abrasive particulates normally present in the ambient atmosphere of the work area. The failure to tightly seal limit switches and door-operated valves is likely to produce, over a period of time, malfunctions that require time and expense to correct, and that adds to down time for the complete blast finishing system in which the improperly functioning components are incorporated.

Further, in the prior art arrangements discussed above, a door switch or door operated valve, should it go out of adjustment, fail, or malfunction, will immediately shut down the entire unit. In such an instance the cause of the shutdown is not immediately obvious to the operator, and considerable time may be lost before the cause is determined.

The present invention aims to overcome the above noted deficiencies characteristic of the prior art devices conceived for the same purpose as the present invention. To this end, the present invention avoids the requirement of limit switches or valves individual to and mounted adjacent the access doors of the blast cabinet, along with the special provisions for sealing them to prevent malfunction. The invention further is designed to eliminate, along with the limit switches and door operated valves, exterior wires or piping on the doors and door frame, all of which have heretofore not only detracted from the appearance of the equipment, but also have had the disadvantage of defining projections that can be accidentally struck, broken off, or pulled away in a manner to cause a safety hazard to adjacent workers, and/or damage to the equipment itself.

SUMMARY OF THE INVENTION

Summarized briefly, the present invention is incorporated in an otherwise conventional blast cabinet, and utilizes a main control valve that controls flow from a source of air under pressure to the blast gun. The valve is per se conventional, and is of the pneumatic pilot-operated type normally biased to a closed position by spring means or the equivalent thereof, and opened by application of air under pressure of a predetermined value, supplied through a pilot line connectable, if desired, to the same source as is used to supply air to the gun or nozzle. A blast cabinet of the type referred to has at least one, and usually two access doors, for insertion or removal of workpieces. In accordance with the invention, the pilot tubing system through which air is supplied to the main valve includes a header, extending transversely of the cabinet and terminating at its opposite ends at the location of the blast cabinet doors. The opposite ends of the header are formed open, and the doors are provided with inexpensive, resiliently compressible pads which, when the door is moved to a sealably closed condition, are compressed against the open ends of the header to seal off the header from the ambient atmosphere. As a result, air pressure is maintained within the pilot tubing for biasing of the main valve to open position permitting air to flow to the blast gun only when the access doors are fully, sealingly closed.

Upon opening of either door, the header end is left open to the ambient atmosphere, as a result of which the pilot tubing is depressurized, instantaneously causing reversion of the main valve to a closed position.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Blast finish cabinets, typically, are either of the "suction" or "pressure" type. In suction-type cabinets air under pressure, directed to a gun, aspirates or sucks into the pressurized air stream a flow of air drawn from the ambient atmosphere through a constantly maintained source of abrasive media, whereby the media-laden air is aspirated into the compressed air flow and discharged from the gun.

In a pressure-type cabinet, the compressed air flow itself picks up the media by passage through the media storage area and is then directed to the gun. The invention is applicable to either type. By way of example, it will be disclosed in a suction-type cabinet.

Figure 1:
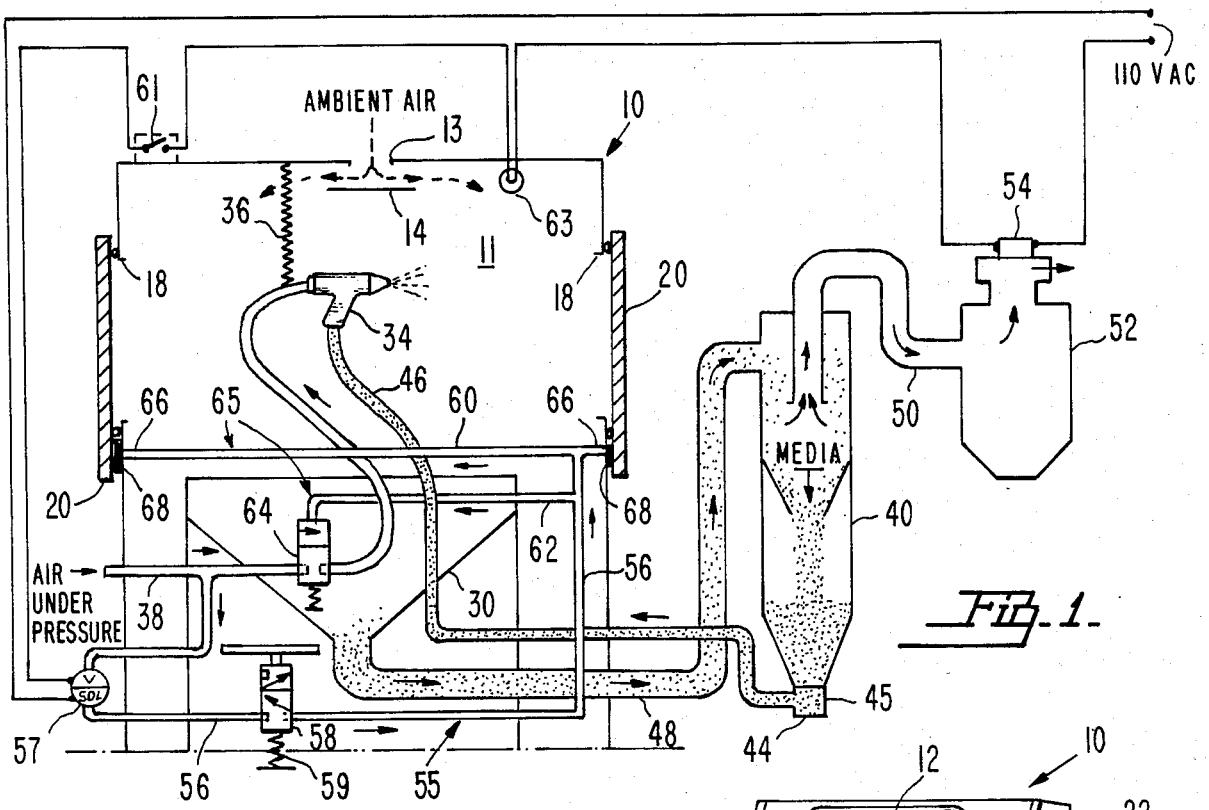
FIG. 1 is a schematic representation of a door interlock system according to the present invention, illustrated in association with an otherwise conventional blast cabinet system, the doors being shown in closed position.
Figure 2:
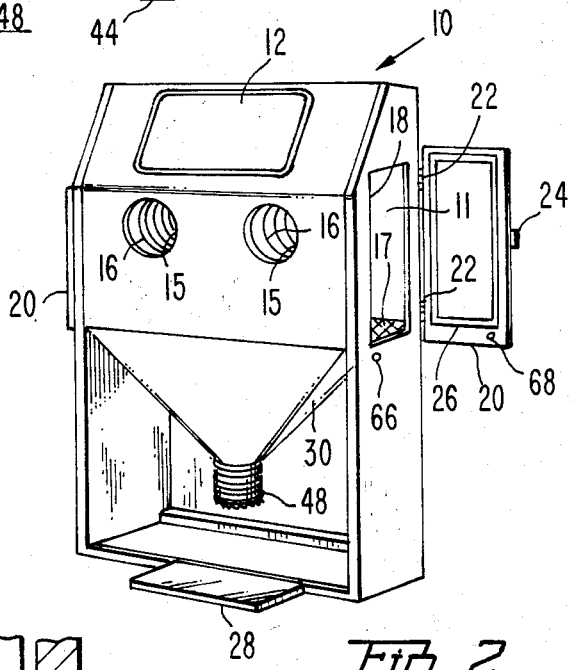
FIG. 2 is a perspective view of a blast finish cabinet equipped with the door interlock system comprising the present invention, one of the doors being shown in open position.

In FIG. 1 there has been illustrated, schematically, a blast finish cabinet generally designated 10, the actual appearance of which may be as shown in FIG. 2. The blast finish cabinet illustrated is of basically conventional appearance, including a blast chamber 11 the front wall of which has a reviewing window 12. An inlet 13 admits ambient air to the blast chamber and is shielded as schematically shown at 14 from the abrasive-laden stream of air discharged under pressure by a blast gun suspended within the chamber.

Formed in the front wall of the cabinet are arm holes 15, to the edges of which are sealably connected inwardly extending, flexible protective sleeves 16 terminating in gloves, not shown. The sleeves and gloves are completely sealed off from the interior of the blast chamber 11 so that one can safely handle a workpiece, not shown, positioned upon the foraminous floor 17 of the blast chamber.

In the illustrated embodiment, access openings 18 are formed in both side walls of the blast chamber to permit free insertion and removal of articles that are to be blast finished therein. The access openings are sealably closed, when the work is being performed upon said articles, by doors 20 which in the illustrated example are mounted on hinges 22, and are equipped with latches 24.

In the embodiment shown in FIGS. 1–4, each door is provided, on its inner face, with a continuous peripheral sealing gasket 26, which is resiliently compressible against the side wall of the blast cabinet about the edge of the associated access opening 18, so that when the door is closed and latched, it will be impossible for media discharged under heavy pressure within the blast chamber, to escape through the access opening into the surrounding ambient atmosphere.

The gaskets 26 of the respective doors can, as shown, be formed as soft rubber tubes, but it will be understood that they can be of any other suitable sealing material, so long as they are adapted to be sealably compressed against the adjacent side wall of the cabinet when the door is closed.

Also conventional in a cabinet of the type described is a foot pedal 28, located at the front of the cabinet, and adapted to be depressed by an operator for the purpose of controlling the flow of air from a suitable source, not shown, to the blast gun.

Also conventional in a blast cabinet of this type is a downwardly tapering hopper or collector 30, through which the abrasive media may gravitate from blast chamber 11 through floor 17.

Also conventional in a system of this type is a blast gun 34, which is suspended within the chamber 11 by a spring suspension cord 36 to facilitate ease of handling of the blast gun by the operator. By way of example, a suction-type system is illustrated in FIG. 1, in which a main air supply line 38 extends from a source of air under pressure through a valve 64 to gun 34. Within a reclaim tank or chamber 40 of the cyclonic type, reusable abrasive media (for example, glass beads) are separated from fines or dust, and gravitate to a separate, lower area to a media regulator valve 44, having an adjustable orifice 45 open to ambient. The stream of air under pressure passing through the gun across the media carrier hose 46 creates a suction within the hose 46, so that media-laden air flowing therethrough is aspirated into the compressed air stream and is discharged under pressure from the gun.

The media, after discharge against the workpiece, are drawn into a suction conduit 48, which opens into the upper portion of the cyclonic reclaimer 40. Here, by conventional means known in the art and requiring no separate illustration, the media are separated from dust and fines, with the media passing downwardly within the reclaimer and the dust and other waste particles being drawn through a connecting conduit 50 that connects the cyclonic reclaimer 40 with a filter chamber 52 provided with a suction or exhaust fan 54. The filter chamber 52 includes suitable filter means, not shown, adapted to retain substantially all contaminants, particulates, or the like, so as to discharge clean exhaust air into the surrounding environment.

All of this is completely conventional, and constitutes, per se, no part of the present invention.

The present invention comprises an improved means for interlocking the doors 20 with the means for supplying air to blast gun 34. To this end, there is provided a pilot tubing system generally designated 55 into which air under pressure is introduced from the same source as is used to supply air to the nozzle or blast gun 34. The pilot tubing 55 includes, thus, a pilot air supply line 56, communicating with the main air supply line 38. The pilot air supply line 56 extends from main line 38 through a normally closed solenoid valve 57. This is in circuit with the main cabinet on-off switch 61, which is conventionally provided to control the lighting 63 within chamber 11, and the operation of the fan 54.

When these electrical devices are off, the cabinet appears to be "shut down". Yet, the air supply would be "live", creating a hazardous condition if one were to be doing maintenance on some of the cabinet'components. Valve 57 prevents this, being opened only when the cabinet's main switch is turned on.

Designated at 58 is a pilot air control valve, which is normally closed, but which is adapted to be opened by depression of foot pedal 28. The foot pedal, in a preferred embodiment, opens the valve against the pressure of a spring 59, so that whenever the operator relieves the pressure on the pedal, the valve immediately reverts to its normally closed position.

Figure 3:
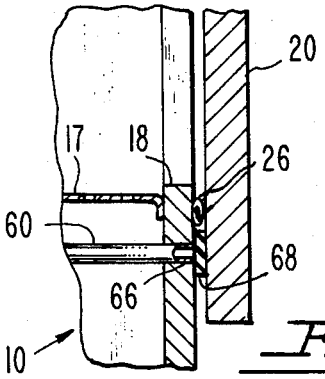
FIGS. 3 and 4 are enlarged, detailed vertical sectional views showing a door of the cabinet in closed and opened positions, respectively.
Figure 4:
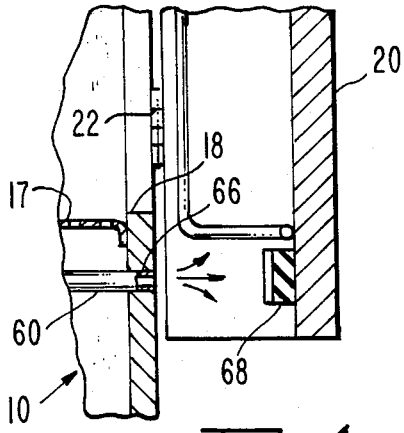

In any event, the valve, which is conventional per se, when opened permits air under pressure to flow through the pilot air supply line 56 to a header 60. Line 56 opens into communication with the header intermediate the opposite ends of the header. Header 60 is disposed transversely of the cabinet, and is so designed as to be disposed interiorly of the front wall of the cabinet, in an out-of-the-way position in which it offers no interference to the performance of finishing operations on a workpiece, and in which it is not subjected to the abrasive action of the media. It may, thus, extend within the cabinet below the floor 17 of the blast chamber as shown in FIGS. 3 and 4.

Opening into communication with the line 56 and also comprising part of the system 55, is a connecting line 62 extending from line 56 to the primary or main control valve 64. Valve 64 is also, per se, conventional, and is normally spring biased to a closed position. Against the restraint of the spring bias, valve 64 can be opened by pressure of a predetermined value exerted thereagainst by air introduced to the valve through connecting line 62. Line 62 thus provides a valve-pressurizing connection, being a component part, along with header 60 and the pilot air supply line 56, of the pilot tubing system generally designated 55. Header 60 and line 62 together comprise a pilot air control line 65.

Header 60, at its opposite ends, is formed open as at 66, with the open ends of the header being flush with the outer surfaces of the side walls of the blast cabinet. The open ends thus represent no projections from the cabinet, and are so disposed as to be engaged by and sealably closed by small, resiliently compressible pads 68 provided upon the inner surfaces of the respective doors 20.

Pads 68 can be of a soft rubber or the like, and in any event, are so proportioned as projections from the inner surfaces of the doors as to assure that the open ends 66 of the header will not be sealably closed unless and until the gaskets 26 have been fully compressed into sealing engagement about the edges of the access openings 18.

Figure 5:
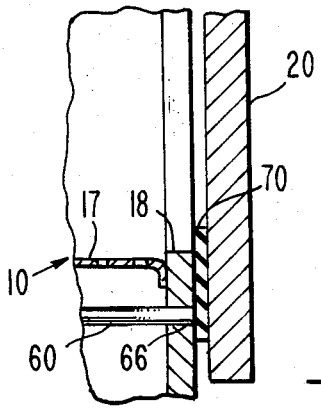
FIG. 5 is a view similar to FIG. 3 illustrating a modified form.

In FIG. 5, there is shown a modification in which the resiliently compressible sealing elements that close the open ends 66 of header 60, are integrally formed as parts of the peripheral sealing gaskets 70 of the doors. Again, however, the construction is such as to assure that the ends 66 of the header will not be sealed off from ambient atmosphere unless and until the doors themselves have sealably closed the access openings of the blast chamber.

In use, the operator who is blast finishing a workpiece simply depresses the treadle 28 whenever he desires to produce a stream of abrasive-laden air under pressure from the nozzle of the blast gun. The depression of the treadle admits air under pressure to the pilot tubing 55, and pressurizes the pilot tubing over its entire length, if both doors 20 are in fully closed positions. In these circumstances, there being no outlet for the pilot air under pressure, valve 64 is pressurized to an extent causing the same to open, so as to admit air from the source of air under pressure, into the main air supply line 38. The air so admitted, as previously described herein, becomes charged with abrasive media at the location of blast gun 34, so that the abrasive media are discharged within blast chamber 11 in a high velocity carrier air stream. The media are continuously reused as previously mentioned. A continuous supply of air needed to draw the media into the conduit 48 results from the provision of the ambient air inlet 13 of the blast chamber, through which air is continuously drawn by operation of the suction fan 54.

If it should happen that one or both of the doors 20 is opened, it will be impossible to direct air under pressure to the blast gun, because the opening of the door exposes the associated, open end 66 of header 60 to ambient atmosphere, thus depressurizing the entire length of pilot tubing 55 and thereby preventing opening of valve 64.

The arrangement is beneficial in that nothing is required, at the locations of the doors, other than leaving the ends 66 of the header open, flush with the side walls of the cabinet. So far as the doors themselves are concerned, nothing is required above and beyond that which is already incorporated in the doors, except the compressible pads 68 or 70. The result is that there are no exterior projections resulting from the door interlock system, since the pilot tubing 55, and the means 66 and 68 at the door locations, are all confined to the interior of the cabinet or are hidden behind the cabinet support legs, or in any event terminate flush with the side walls of the cabinet. The necessity of limit switches or special valves at the door locations, mounted exteriorly of the cabinet and protectively enclosed against the admission of contaminants, is dispensed with, in use of the interlock system comprising the present invention.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a blast-finish cabinet in which the surfaces of articles may be blast-finished by abrasive media carried in a stream of air supplied from a source of air under pressure, the cabinet having a blast chamber provided with at least one opening providing access to the interior of the chamber, said opening being normally closed by a latched access door openable by a user to permit said articles to be inserted in and removed from the cabinet interior through said opening, a blast nozzle within the chamber for directing against the article surface abrasive media carried in said stream of air under pressure, and a primary air line through which the carrier air is supplied under pressure directly from said source to the nozzle, an improved interlock system for shutting off the supply of air to the nozzle whenever the door is inadvertently left unlatched and open, comprising:

(a) a normally closed main control valve of the pneumatic, pilot-air-controlled type mounted in the primary line and comprising the sole valve controlling the passage of the carrier air through the primary line;

(b) a pilot air tubing system disposed wholly outside the flow path of the carrier air stream passing through the primary line from said source to the nozzle and including (1) a pilot air supply line branching off from and connected in communication with the primary line at a location between said source and the valve; and (2) a pilot air control line in communication with the pilot air supply line and having at least one outlet opening to the ambient atmosphere, the control line having a connection to the main valve effective to operate the valve to open position in the presence of air under pressure within the control line;

(c) means on the door adapted to sealably close the outlet opening of the pilot air control line responsive to closing and latching of the door, the outlet opening exhausting to the ambient atmosphere air flowing into the pilot air tubing system from said source when the door is left open, whereby to de-pressurize the pilot air control line and thus prevent operation of the valve from its normally closed condition; and (d) a normally closed secondary valve adapted for operation under the control of an operator and mounted to control flow through the pilot air supply line, said secondary valve being mounted wholly out of the path of the carrier air stream flowing from said source through the primary line to the nozzle.

2. In a blast-finish cabinet, the improvement of claim 1 in which said means on the door is adapted to be sealably compressed against the control line in the area of the outlet opening to close and seal the outlet opening, responsive to movement of the door to a fully closed position.

3. In a blast-finish cabinet, the improvement of claim 2 in which said means on the door is a soft, resiliently compressible element.

4. In a blast-finish cabinet, the improvement of claim 3 in which the control line is formed with an open end to provide said outlet opening, the open end of the control line being in confronting relation to said element for closure of the open end thereby when the door is closed.

5. In a blast-finish cabinet, the improvement of claim 1, in which the control line includes a header communicating intermediate its ends with the pilot air supply line.

6. In a blast-finish cabinet, the improvement of claim 5, in which the header has an open end defining said outlet opening and adapted to be sealably engaged and closed by said means on the door when the door is closed.

7. In a blast-finish cabinet, the improvement of claim 5, wherein the cabinet has two doors located in opposite walls of the chamber, the header having opposite ends both of which are formed open and are in confronting relation to the respective doors to provide a pair of said outlet openings, said means being provided on both doors in position to seal the respective outlet openings when the doors are closed, whereby to require closure of both of said doors to maintain the control line in a pressurized state.

8. In a blast-finish cabinet, the improvement of claim 3 in which the door includes a peripheral, compressible sealing gasket adapted to be compressed, on movement of the door to a closed position, to a sealing condition prior to compression of said element to a condition sealably closing the outlet opening in the control line.

9. In a blast-finish cabinet, the improvement of claim 3 in which said element is an integral part of a peripheral sealing gasket mounted on the door in position to provide a door seal for the cabinet when the door is in closed position.

10. In a blast-finish cabinet, the improvement of claim 1 wherein the control line includes a header extended transversely of the cabinet and the supply line intersects with the header between the opposite ends thereof, the header having both ends formed open and opening laterally outwardly of the cabinet to provide a pair of said outlet openings, the cabinet having two doors one at each side thereof and said means being provided on each door in confronting relation to the open ends of the header.

11. In a blast-finish cabinet, the improvement of claim 10 wherein the connection of the control line to the main valve comprises a length of tubing extending from the main valve and intersecting with the pilot air supply line.

12. In a blast-finish cabinet, the improvement of claim 11 wherein said secondary valve has a foot treadle depressible by a user to open the secondary valve, the secondary valve being mounted to control flow through the air supply line and being disposed downstream from the header.

* * * * *